US005324576A

United States Patent [19]

Reed et al.

[11] Patent Number: 5,324,576

[45] Date of Patent: Jun. 28, 1994

[54] POLYOLEFIN MELTBLOWN ELASTIC WEBS

[75] Inventors: John F. Reed, Arden Hills; Michael Swan, Woodbury, both of Minn.

[73] Assignee: Minnesota Mining and Manufacturing Company, St. Paul, Minn.

[21] Appl. No.: 111,982

[22] Filed: Aug. 25, 1993

[51] Int. Cl.[5] ..... D03D 3/00

[52] U.S. Cl. ..... 428/224; 156/167; 428/288; 428/903

[58] Field of Search ..... 428/224, 288, 296, 903; 156/167

[56] References Cited

U.S. PATENT DOCUMENTS

| | | | |
|---|---|---|---|
| 4,076,698 | 2/1978 | Anderson et al. | 526/348.6 |
| 4,644,045 | 2/1987 | Fowells | 526/348 |
| 4,657,802 | 4/1987 | Morman | 428/152 |
| 4,663,220 | 5/1987 | Wisneski et al. | 428/221 |
| 4,724,184 | 2/1988 | Killian et al. | 428/227 |
| 4,741,949 | 5/1988 | Morman et al. | 428/224 |
| 4,755,178 | 7/1988 | Insley et al. | 604/376 |
| 4,789,699 | 12/1988 | Kieffer et al. | 524/271 |
| 4,804,577 | 2/1989 | Hazelton et al. | 428/224 |
| 4,830,907 | 5/1989 | Sawyer et al. | 428/225 |
| 4,874,447 | 10/1989 | Hazelton et al. | 156/167 |
| 4,879,170 | 11/1989 | Radwanski et al. | 428/233 |
| 4,908,263 | 3/1990 | Reed et al. | 428/286 |
| 4,909,975 | 3/1990 | Sawyer et al. | 428/903 |
| 4,957,795 | 9/1990 | Riedel | 428/74 |
| 4,990,204 | 2/1991 | Krupp et al. | 156/167 |
| 5,066,542 | 11/1991 | Tabor et al. | 428/461 |
| 5,112,686 | 5/1992 | Krupp et al. | 428/401 |
| 5,133,917 | 7/1992 | Jezic et al. | 264/210.8 |
| 5,234,731 | 8/1993 | Ferguson | 428/34.9 |

FOREIGN PATENT DOCUMENTS

| | | | |
|---|---|---|---|
| WO93/06169 | 1/1993 | PCT Int'l Appl. | C08L 23/12 |

OTHER PUBLICATIONS

Wente, Van A., "Superfine Thermoplastic Fibers", *Industrial Engineering Chemistry,* vol. 48, pp. 1342–1346.

Wente, Van A., "Manufacture of Superfine Organic Fibers", Report No. 4364 of the Naval Research Laboratories, published May 25, 1954.

*Primary Examiner*—James J. Bell

*Attorney, Agent, or Firm*—Gary L. Griswold; Walter N. Kirn; William J. Bond

[57] ABSTRACT

An elastic nonwoven web of microfibers of radiation crosslinked ethylene/alpha-olefin copolymers. The web has an elongation to break of at least 400 percent and generally is comprised of meltblown microfibers. The ethylene/alpha olefin is preferably an ethylene/1-octene copolymer having a density less than 0.9 g/cm$^3$ and a melting point of less than 100° C.

15 Claims, No Drawings

POLYOLEFIN MELTBLOWN ELASTIC WEBS

FIELD OF THE INVENTION

The invention relates to nonwoven meltblown fibrous elastic webs comprised predominantly of meltblown fibers formed from ethylene/alpha-olefin copolymers.

BACKGROUND OF THE INVENTION

U.S. Pat. No. 4,879,170 describes a nonwoven elastomeric web formed by hydraulically entangling a nonwoven meltblown web with pulp fibers, staple fibers, additional meltblown fibers or continuous filaments, at least one of which fibers is elastomeric. Elastomeric materials described as suitable for forming an elastomeric meltblown web include polyesters, polyurethanes, polyetheresters and polyamides referring to U.S. Pat. No. 4,657,802. Other elastomeric materials are mentioned, however, not in reference to formation of meltblown fibers. Such elastomers include elastomeric polyolefins, elastomeric copolyesters and ethylene/vinyl acetates. The co-formed material is described as being a smooth elastic with good hand, drape and other properties.

U.S. Pat. No. 4,724,184 describes an elastomeric nonwoven web formed by meltblown fibers comprised of a polyether/polyamide block copolymer such as sold under the trade designation PEBAX TM 3533. The elastic meltblown nonwoven web formed from this elastomer is a coherent matrix of microfibers with optionally secondary fibers incorporated into the web.

Additional patents describing elastomeric meltblown webs include U.S. Pat. No. 4,663,220 which describes polyalkenyl arenes/polydiene block copolymers such as A-B-A block copolymers sold under the trade designation KRATON TM G, which include polystyrene/-polyethylene-butylene/polystyrene block copolymers. These block copolymers are blended with polyolefins to enhance processability into formation of the elastomeric meltblown web, which elastomeric webs are also discussed in U.S. Pat. No. 4,789,699.

U.S. Pat. No. 4,741,949 describes an elastomeric web formed from a polyether/polyester. Again, the web may optionally contain secondary fibers distributed therein including wood pulp, staple fibers, superabsorbent fibers or binding fibers. The loading of the secondary fibers depends on the fiber average length, with smaller fibers, less than 0.5 in. in length, includable up to 80 weight percent of the web, whereas larger fibers are only includable up to 40 weight percent.

U.S. Pat. No. 4,908,263, to Reed et al., describes a nonwoven insulating fabric formed from elastomeric meltblown fibers admixed with staple bulking fibers. The bulking fibers having on average at least ½ crimp/cm. The meltblown materials described are formed from elastomeric polyurethanes, polyesters, polyamides or polyalkenyl arene/polydiene block copolymers such as polystyrene/polydiene block copolymers. The preferred elastomeric material is a polyurethane.

There continues to be a need for elastomeric meltblown webs for a variety of applications specifically formed from thermoplastic polymers having improved meltblown processing characteristics and useful elastic and tensile properties in a meltblown web form.

SUMMARY OF THE INVENTION

The present invention provides an elastic meltblown web comprising crosslinked ethylene/alpha-olefin copolymers, particularly ethylene/1-octene copolymers. The elastomeric meltblown web comprises a nonwoven fibrous matrix of radiation crosslinked ethylene/alpha-olefin microfibers having an average diameter of generally less than about 75 micrometers, preferably less than about 50 micrometers and, most preferably, less than about 25 micrometers. The elastomeric meltblown web has an elongation to break of at least 400 percent, preferably at least 500 percent.

The elastomeric meltblown web or matrix is provided by melt blowing an ethylene/alpha-olefin, particularly an ethylene/1-octene copolymer having a density of less than about 0.9 gm/cm$^3$, preferably less than 0.88 gm/cm$^3$, a melt index of greater than 25 gm/10 min (measured by ASTM D-1238, Condition E), preferably greater than 50 gm/10 min, and a melting point of less than 100° C., preferably less than 80° C. The coherent matrix of meltblown fibers are collected on a collecting surface and then subjected to radiation crosslinking, particularly electron beam radiation in amounts generally greater than about 5 megarads, preferably at least 10 megarads, to provide a coherent elastomeric meltblown web having an elongation to break of at least 400 percent and elastic recovery.

DETAILED DESCRIPTION OF THE INVENTION

The pre-irradiation processed nonwoven meltblown webs of the present invention can be prepared by a process similar to that taught in Wente, Van A., "Superfine Thermoplastic Fibers" in Industrial Engineering Chemistry, Vol. 48, pages 1342 et seq (1956), or in Report No. 4364 of the Naval Research Laboratories, published May 25, 1954 entitled "Manufacture of Superfine Organic Fibers" by Wente, Van. A. Boone, C. D., and Fluharty, E. L. except that a drilled die is preferably used. The thermoplastic material is extruded through the die into a high velocity stream of heated air which draws out and attenuates the fibers prior to their solidification and collection. The fibers are collected in a random fashion, such as on a perforated screen cylinder, prior to complete fiber solidification so that the fibers are able to bond to one another and form a coherent web which does not require additional binders. This bonding is desirable to improve mechanical properties.

Post-extrusion crosslinking of the formed meltblown webs is accomplished by passing the webs through a conventional electron beam irradiation device operating under normal conditions. However, it is believed that other radiation sources could also work, such as alpha, gamma or beta radiation. Under the range of conditions examined, enhanced web properties were correlated with increasing radiation exposures. The radiation exposure was generally at least 5 megarads, with at least 10 megarads being preferred. The resulting web exhibited elongations to break of at least 400 percent, preferably at least 500 percent, and most preferably at least 600 percent, while exhibiting peak loads at least 20 percent higher than a non-treated or non-irradiated web, preferably at least 30 percent higher, and most preferably at least 50 percent higher.

Particularly preferred ethylene/alpha-olefins are suitably described as interpolymers of an alpha-olefin, particularly ethylene and a $C_3$–$C_{12}$ alpha-olefin, particularly $C_4$–$C_8$ alpha-olefins with 1-octene being particularly preferred, with alpha-olefin amounts preferably greater than 20 mole percent of the polymer up to about 70 mole percent, preferably, less than 50 mole percent alpha olefin and, optionally, a minor proportion of diene monomers. The ethylene/alpha-olefins generally have a melt index above about 10 gm/10 min., preferably above 25 gm/10 min. and, most preferably above 50 gm/10 min. (measured by ASTM D-1238, Condition E). Further, preferably, the polymer has a Vicant softening point of less than about 60° C., preferably less than 50° C., providing a broad processing window and ability to form a coherent web at a wide range of collector distances, while providing a web capable of low temperature thermal processing such as a particular ethylene/1-octene copolymer having a melt index of 80–100, a melt flow ratio of 7.3, a density of 0.871 (measured by ASTM D-792), a Vicant softening point (measured by ASTM D-1525) of 40° C. and a melting point of 64° C. (as determined by differential scanning calorimeter). Mechanical properties of this polymer measured by ASTM D-638 include a tensile strength at yield of 170 PSI, a tensile strength at break of 350 PSI, and an elongation of 430 percent, flexural strength and flexural modulus measured by ASTM D-790 of 850 PSI and 2,260 PSI, respectively, rigidity of 1,000 PSI, by ASTM D-747, with a hardness (shore A) of 70 as determined using ASTM D-2240. This polymer is designated as Dow Insite TM XUR-1567-48562-9D and is formed by a constrained geometry metallocene addition catalyst.

Additionally, various particulate materials and staple fibers can be incorporated into the coherent elastomeric web during the web formation process by well known methods such as described in U.S. Pat. Nos. 4,755,178 and 4,724,184.

The following examples are currently contemplated preferred modes for carrying out the invention and should not be considered as limiting unless otherwise indicated.

EXAMPLES 1–5

Pre-irradiation processed nonwoven melt blown webs were prepared using an ultra-low density ethylene/1-octene copolymer (Insite TM, XUR-1567-48562-9D, density 0.871, melt index 95.8, available from Dow Chemical Company, Midland Mich.). The peak melting point was determined by DSC, scan rate 5° C./min., second heat, as about 69° C. and reported by the manufacturer as 64° C. The Vicant softening point was reported as 40° C. The webs were formed by a process similar to that described in Wente, Van A., "Superfine Thermoplastic Fibers" in Industrial Engineering Chemistry, Vol. 48, pages 1342 et seq (1956), or in Report No. 4364 of the Naval Research Laboratories, published May 25, 1954 entitled "Manufacture of Superfine Organic Fibers" by Wente, Van. A. Boone, C. D., and Fluharty, E. L. except that a 1.9 cm (0.75 in.) Brabender single screw extruder equipped with a 25/1 L/D screw was used and the meltblowing die had smooth surfaced orifices (10/cm) with a 5:1 length to diameter ratio. The melt temperature was 210° C., the die was maintained at 200° C., the primary air temperature and pressure were, respectively, 198° C. and 55.2 kPa (0.76 mm gap width), the polymer throughput rate was 2.4 gm/cm/minute, and the collector/die distance was 46 cm (18 in.). The resulting nonwoven web had an average fiber size of 12 microns (range of 4–17 microns) and a basis weight of approximately 100 g/m$^2$. The thus formed meltblown web was subjected to post-blowing electron beam irradiation levels as indicated in Table 1 using a custom built electron beam machine equipped with a tungsten filament and a 12 μm thick titanium window which was capable of delivering an acceleration voltage over a range of 100–300 KeV (available from Energy Sciences, Inc. Wilmington, Mass.). The machine was operated at a 250 KeV energy level, with exposures of 5, 10, 15, and 20 MRads for the preparation of the webs of the present invention. Web samples were placed on a poly(ethylene terephthalate) carrier film and irradiated in a nitrogen inerted chamber (oxygen level of approximately 5 ppm) and a line speed of 9.14 m/min (30 ft./min). Physical properties of the irradiated webs were measured on an Instron TM Tester, Model 1122 (available from Instron Corp., Canton, Mass.) with a jaw gap of 5.08 cm (2 in.) and a head speed of 25.4 cm/minute (10 in./minute) and analyzed using Instron TM Series 9 software. Web samples (2.54 cm×8.9 cm) were die cut along the machine direction axis. Physical property data for the samples is reported in Table 1.

COMPARATIVE EXAMPLES C-1 thru C-5

Comparative examples were prepared according to the procedure of Examples 1–5 except for using a linear low density polyethylene resin (Aspun TM 6806, density 0.930, melt index 105, available from Dow Chemical Co.), with a peak melting point of 121° C. (determined by DSC, as above). The melt temperature was 229° C., the die temperature was 235° C., the primary air temperature and pressure were, respectively, 231° C. and 96.5 kPa (0.76 mm gap width), the polymer throughput rate was 1.2 gm/cm/minute, and the collector/die distance was 14.4 cm (6 in.). The resulting nonwoven web had an average fiber size of 5–10 microns and a basis weight of about 71 g/m$^2$. The webs of comparative examples C-1 thru C-5 were exposed to the same E-beam radiation levels as the webs of examples 1–5. The physical property data for all the samples is reported in Table 1.

TABLE 1

| | | Web Properties | | | |
|---|---|---|---|---|---|
| Example | Radiation (MRads) | Basis Weight (g/m$^2$) | Peak Load (kg) | Peak Load Strain (%) | Elongation at Break (%) |
| 1 | 0 | 130 | 0.54 | 266 | 285 |
| 2 | 5 | 133 | 0.63 | 405 | 426 |
| 3 | 10 | 127 | 0.72 | 521 | 546 |
| 4 | 15 | 129 | 0.86 | 601 | 622 |
| 5 | 20 | 135 | 1.08 | 719 | 730 |
| C-1 | 0 | 72 | 0.21 | 9 | 42 |
| C-2 | 5 | 71 | 0.23 | 10 | 43 |
| C-3 | 10 | 74 | 0.31 | 15 | 60 |
| C-4 | 15 | 73 | 0.32 | 14 | 46 |
| C-5 | 20 | 72 | 0.34 | 14 | 63 |

The data in Table 1 shows a significant improvement in elastic properties of the nonwoven webs of the present invention upon radiation treatment. In contrast, the webs of the comparative examples exhibited only slight improvement in elastic and tensile properties under identical irradiation conditions.

The various modifications and alterations of this invention will be apparent to those skilled in the art without departing from the scope and spirit of this invention, and this invention should not be restricted to that set forth herein for illustrative purposes.

I claim:

1. An elastic nonwoven web comprising a nonwoven fibrous matrix of crosslinked elastomeric ethylene/alpha-olefin copolymer microfibers, the elastomeric ethylene/1-octene random copolymer having a density of less than 0.9 gm/cm$^3$ wherein the web has an elongation to break of at least 400 percent and recovers elastically.

2. The elastic nonwoven web of claim 1 wherein the ehtylene/alpha-olefin is a radiation crosslinked ethylene/1-octene random copolymer having a melting point of less than 100° C., and the fibers have a diameter of less than 50 micrometers.

3. The elastic nonwoven web of claim 1 wherein the ethylene/alpha-olefin is a radiation crosslinked ethylene/1-octene random copolymer having a melting point of less than 80° C. and a density of less than 0.88 gm/cm$^3$, and the fibers have a diameter of less than 50 micrometers.

4. The elastic nonwoven web of claim 3 wherein the web has an elongation to break of at least 500 percent.

5. The elastic nonwoven web of claim 3 wherein the web has an elongation to break of at least 600 percent.

6. The elastic nonwoven web of claim 2 wherein the web peak load is at least 20 percent higher than a comparable non-radiation crosslinked web.

7. The elastic nonwoven web of claim 4 wherein the web peak load is at least 30 percent higher than a comparable non-radiation crosslinked web.

8. The elastic nonwoven web of claim 4 wherein the web peak load is at least 50 percent higher than a comparable non-crosslinked web.

9. The elastic nonwoven web of claim 1 wherein the alpha-olefin is a $C_3$–$C_{12}$ alpha-olefin.

10. The elastic nonwoven web of claim 1 wherein the alpha-olefin is a $C_4$–$C_8$ alpha-olefin.

11. The elastic nonwoven web of claim 2 wherein the ethylene/1-octene Vicant softening point is less than about 60° C.

12. The elastic nonwoven web of claim 3 wherein the ethylene/1-octene Vicant softening point is less than about 50° C.

13. The elastic nonwoven web of claim 2 wherein the ethylene/1-octene melt index is greater than about 10 gm/10 min.

14. The elastic nonwoven web of claim 2 wherein the ethylene/1-octene melt index is greater than about 25 gm/10 min.

15. The elastic nonwoven web of claim 3 wherein the ethylene/-octene melt index is greater than about 50 gm/10 min.

* * * * *

UNITED STATES PATENT AND TRADEMARK OFFICE

CERTIFICATE OF CORRECTION

PATENT NO. : 5,324,576

DATED : June 28, 1994

INVENTOR(S) : Reed et al.

It is certified that error appears in the above-indentified patent and that said Letters Patent is hereby corrected as shown below:

Column 6, line 24, delete "ethylene/-octene" and insert --ethylene/1-octene--.

Signed and Sealed this

Thirtieth Day of August, 1994

*Attest:*

*Attesting Officer*

Bruce Lehman

BRUCE LEHMAN

*Commissioner of Patents and Trademarks*